United States Patent [19]

Lan

[11] Patent Number: 4,536,136

[45] Date of Patent: Aug. 20, 1985

[54] FILM-MADE PUMP DRIVEN BY THE FILLING EFFECT OF A FLUID ON FILLING INTO A CHAMBER MADE OF FILM

[76] Inventor: Yung-Huei Lan, 3 Fl. 32. Lane 61, Section 2, Hang Chou S. Rd., Taipei, Taiwan

[21] Appl. No.: 477,610

[22] Filed: Mar. 22, 1983

[51] Int. Cl.[3] ..... F04B 9/08; F04B 43/10; F04B 45/00

[52] U.S. Cl. ..... 417/389; 417/394; 417/473

[58] Field of Search ..... 417/383, 389, 394, 472, 417/473, 479, 903, 385–388; 60/583; 92/48, 39

[56] References Cited

U.S. PATENT DOCUMENTS

| | | | |
|---|---|---|---|
| 418,232 | 12/1889 | Sallade | 417/472 |
| 1,016,830 | 2/1912 | Jack | 417/903 |
| 2,686,006 | 8/1954 | Hasselquist | 92/47 |
| 3,218,979 | 11/1965 | Baldwin | 417/389 |
| 3,409,184 | 11/1968 | Stengle | 417/472 |
| 3,444,922 | 5/1969 | Dingman | 417/473 |
| 3,774,611 | 11/1973 | Tussey | 417/472 |
| 3,875,941 | 4/1975 | Adair | 417/472 |
| 4,116,589 | 9/1978 | Rishton | 417/384 |

*Primary Examiner*—Leonard E. Smith
*Assistant Examiner*—Jane E. Obee
*Attorney, Agent, or Firm*—Cushman, Darby & Cushman

[57] ABSTRACT

A method and apparatus advantageously using the shapeless and flowing characteristics of a fluid. The fluid is contained with a suitable film chamber having a given shape; a frame or the like may be used as a supporting means for the chamber. The frame-shaped sack is repeatedly filled and exhausted with a fluid; upon being filled with fluid, it is inflated; upon the fluid therein being exhausted, it becomes deflated. A hollow chamber is supported with a film sack by repeatedly filling and exhausting fluid therefrom so as to have the hollow sack inflated and compressed. By using this method, the hollow sack is used as a pump for pumping a fluid therefrom.

5 Claims, 4 Drawing Figures

FILM-MADE PUMP DRIVEN BY THE FILLING EFFECT OF A FLUID ON FILLING INTO A CHAMBER MADE OF FILM

BACKGROUND OF THE INVENTION

Pumping a fluid in accordance with conventional mechanical methods requires a hard, thick, heavy and bulky mechanism. Such conventional methods consume a lot of material, require special manufacturing procedures, and have high manpower costs.

In view of these disadvantages, the inventor has developed an apparatus and method whereby a fluid supported chamber directly pumps a separate fluid in a separate pumping chamber. For that purpose, film chambers, in suitable shapes for containing such fluids are used in the repeated pumping, and they may be used to substitute the conventional pump in many occasions.

SUMMARY OF THE INVENTION

The present invention relates to a pump; the pump is composed of a film. The pump body portion comprises a pumping chamber composed of a film material and a supporting chamber composed of film material. A fluid filled into the supporting chamber simultaneously inflates the separate pumping chamber with the fluid that is to be pumped from the pumping chamber. Upon being compressed, the fluid in the supporting chamber will be compressed to change its form and enter into a secondary chamber for temporary storage (in liquid state) for repeated use.

More particularly, the present invention relates to a method and apparatus by which the shapeless and flowing characteristics of a fluid can be used. The fluid is contained with a suitable film chamber having a given shape; a frame or the like may be used as a supporting means for the chamber. The chamber is repeatedly filled and exhausted with a fluid; upon being filled with fluid, it is inflated; upon the fluid therein being exhausted, it becomes deflated. A hollow chamber is supported with a film sack by repeatedly filling and exhausting fluid therefrom so as to have the hollow chamber inflated and compressed. By using this method, the hollow chamber is used as a pump for pumping a fluid therefrom.

DETAILED DESCRIPTION OF THE INVENTION

Figure 1:
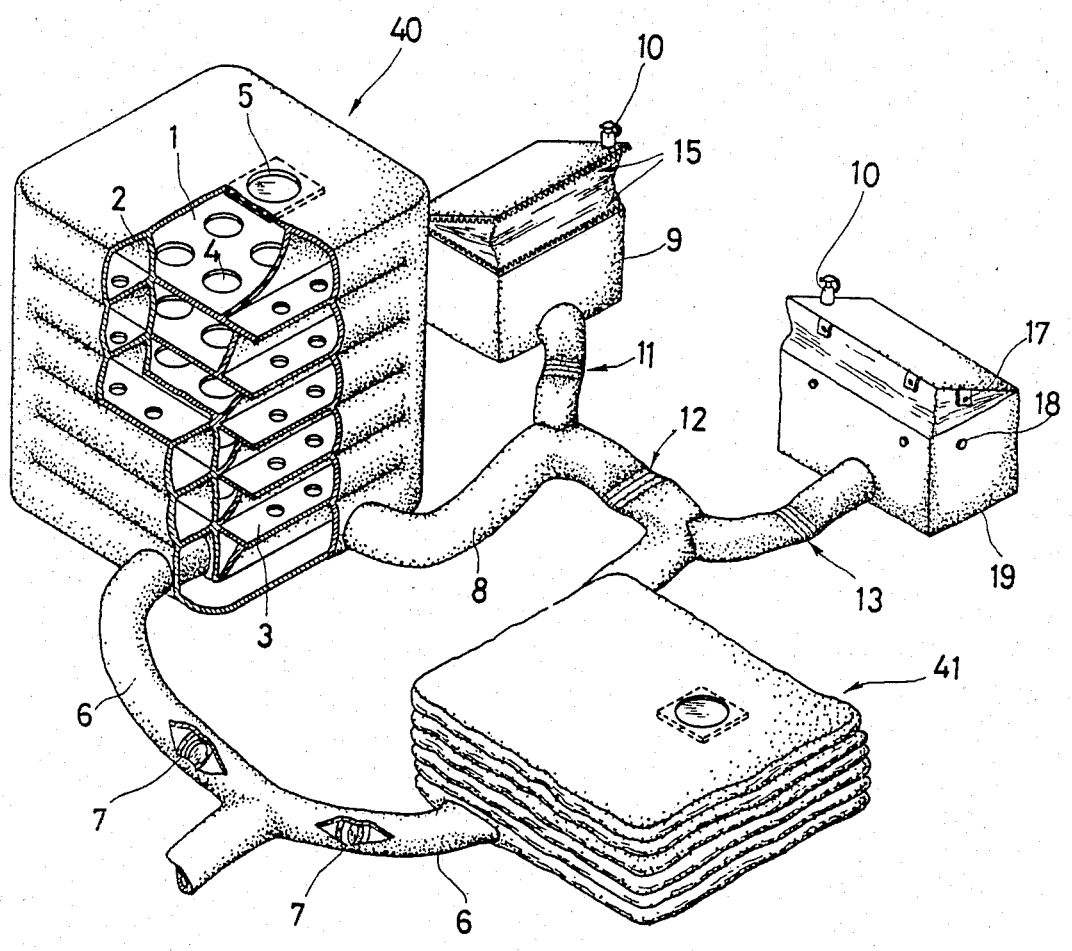
FIG. 1 is a perspective view of the basic structure of the present invention.

As shown in FIG. 1, the fluid supporting pump body mainly comprises the pumping chamber 1 and the supporting chamber 2, which are two completely isolated chambers. The pump may be tube-shaped or another shape so long as it is able to contain a fluid. Air is the filling medium of choice in the pumping chamber, whereas water is the filling medium of choice in a filled supporting chamber. Between both of the chambers there are a plurality of connecting films 3 to interconnect the walls at both sides to maintain structural integrity of the pump 40 body. The connecting films 3 are provided at suitable positions between the pumping chamber 1 and the supporting chamber 2 in order to space apart the walls of the aforesaid respective chambers. Connecting films 3 have passageways cut therethrough to enable the supporting medium to circulate throughout the supporting chamber. Within the pumping chamber 1, there are connecting plates extending between the interior walls of the chamber 1. Each hole 4 in each plate provides for the circulation of fluid within the pumping chamber. On the top of the pumping chamber 1 there is a one-way air inlet 5. At the bottom of pumping chamber 1 there is an exhausting hose 6. Check valve 7 in exhausting hose 6 is furnished to control the fluid flow during pumping from pumping chamber 1, i.e. to prevent fluid exhausted from pumping chamber 1 through hose 6 from filling the other pump body 41 (deflated) shown in FIG. 1.

The supporting chamber 2 is communicating with the secondary chamber 9 via a connecting hose 8. On the top of secondary chamber 9, a closed inlet 10 is furnished. The secondary chamber 9 may have a zipper 15 as shown in FIG. 1. Zipper 15 may be ripped in order to obtain a suitable volume for secondary chamber 9. The other secondary chamber 19 has snap closures 17 and 18 as is shown in FIG. 1. Snap closures 17 and 18 may be snapped together to obtain a suitable volume for secondary chamber 19.

Figure 4:
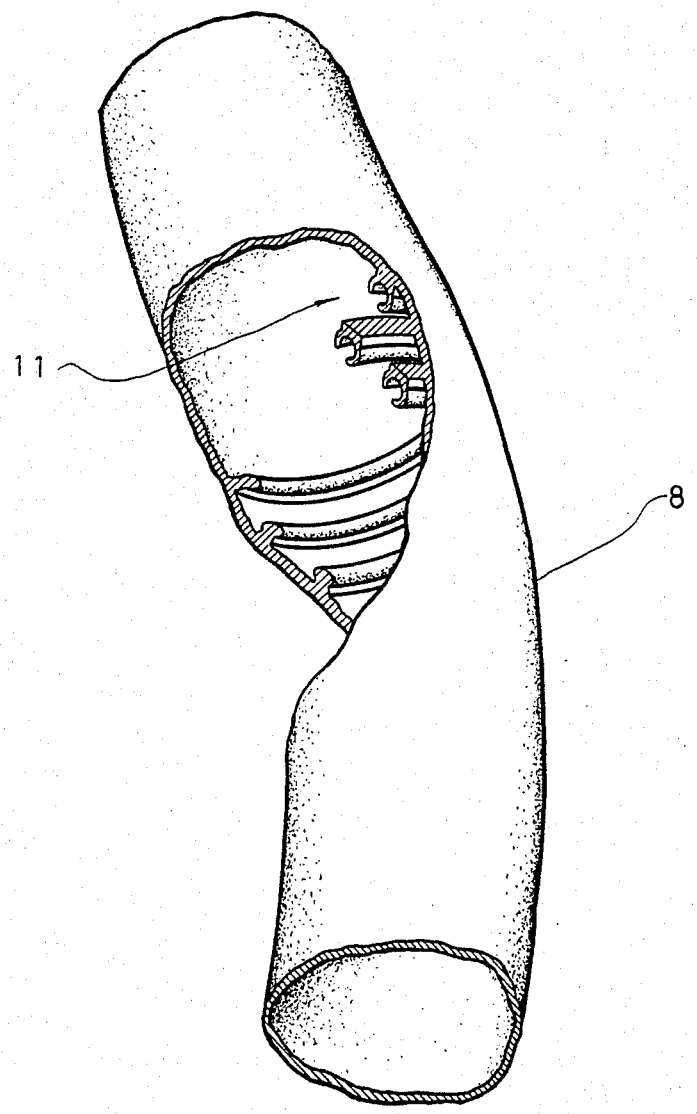
FIG. 4 illustrates fastening tape 11 shown in FIG. 1.

Before being used, the pump is in a flat shape as shown at the right side in FIG. 1. The following describes the operation of one pump body shown in FIG. 1. Fasteners 12 and 13 are closed. Upon being used, the secondary chamber 9 is charged with water via the inlet 10; then, the fastening tape 11 in the connecting hose 8 is opened, and the secondary chamber 9 is compressed to press the water therefrom into the supporting chamber 2 for inflating the latter. Connecting films 3 maintain the integrity of pump body 40 as supporting chamber 2 is inflated. At the same time that the supporting chamber 2 is being filled, the pumping chamber 1 is drawing air in the ambient atmosphere via the one-way air inlet 5. Secondary chamber 9 deflates as fluid exits therefrom through connecting hose 8 and fills support chamber 2. Secondary chamber 9 is deflated after supporting chamber 2 is filled. By pressing downward on inflated pump body 40, the water in the supporting chamber 2 will flow back through hose 8 and open fasteners 11 (FIG. 4.) into the secondary chamber 9 for storage. Concurrently, the air in the pumping chamber 1 is compressed out via the exhausting hose 6, and then the same operation cycle is repeated continuously.

The aforesaid pairs of respective pumping structures form a complete device as shown in FIG. 1. Upon compressing the two pumping structures (left and right) respectively, the air may continuously be pumped out. More than a brace of pumping structures can be used; in that situation, by analogy, the same operation still obtains.

In addition, if a given part of the pumping structure is damaged, then an operable pump (supposing the one on the left in FIG. 1 is operable) can be converted to have the water in the supporting chamber 2 switched to compressible air.

Furthermore if the wall of the supporting chamber and/or the wall of a secondary chamber has strong elasticity, then the quality of the pump will be much better.

As will be appreciated by those skilled in the art, fasteners 11, 12 and/or 13 on hose 8 may be closed to thereby close the passageway defined by the interior walls of hose 8. Fasteners 11, 12, and 13 are assembled in or molded integral with connecting hose 8. (FIG. 4) Fasteners 11 are usually opened. (FIG. 4) Fasteners 12 and 13 can be open or closed depending on fluid needs. The function of these fasteners is the same as valves found in piping. The function of these fasteners is the same as valves found in piping. The fasteners can control fluid flow or reduce the flow of fluid in connecting hose 8. The preferred structure is similar to the sealing structure about the opening of a conventional plastic bag, but (tape) fasteners 11, 12 and 13 at each place comprise a plurality of such sealing structures. When the user wants to cut the flow of fluid in a connecting hose 8, he only needs to pinch the fasteners 11, 12, and 13 from outside hose 8. When the user wants to open the fasteners, he only rubs the exterior surface of hose 8 to let fasteners 11, 12, and 13 release in total or in part and the fasteners 11, 12, and 13 can be opened.

Figure 2:
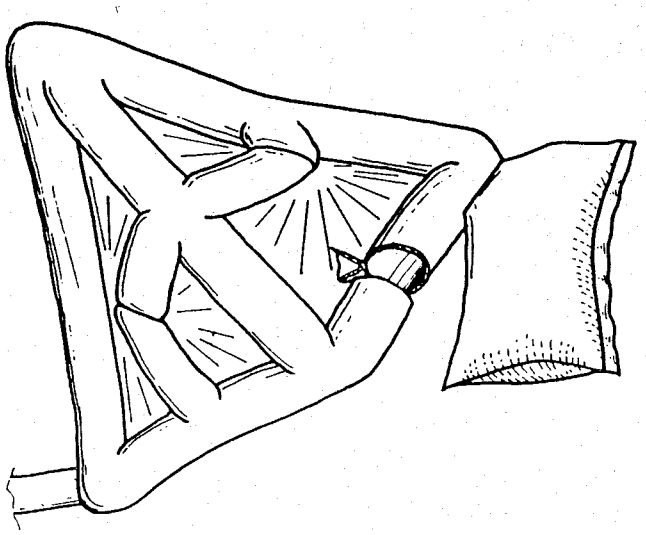
FIG. 2 is a perspective and sectional view of Embodiment I of the present invention.

FIG. 2 is a perspective and sectional view of Embodiment I, in which the pillow-shaped device is functionally equivalent to the secondary chamber 9 in FIG. 1, while the netshape hose frame is equivalent to the supporting chamber 2 in FIG. 1; the space between the pipes in the pipe network ("support chamber" or hose frame) is equivalent to the pumping chamber 1 in FIG. 1. The projected portion at the bottom is equivalent to the exhausting hose 6 in FIG. 1.

Figure 3:
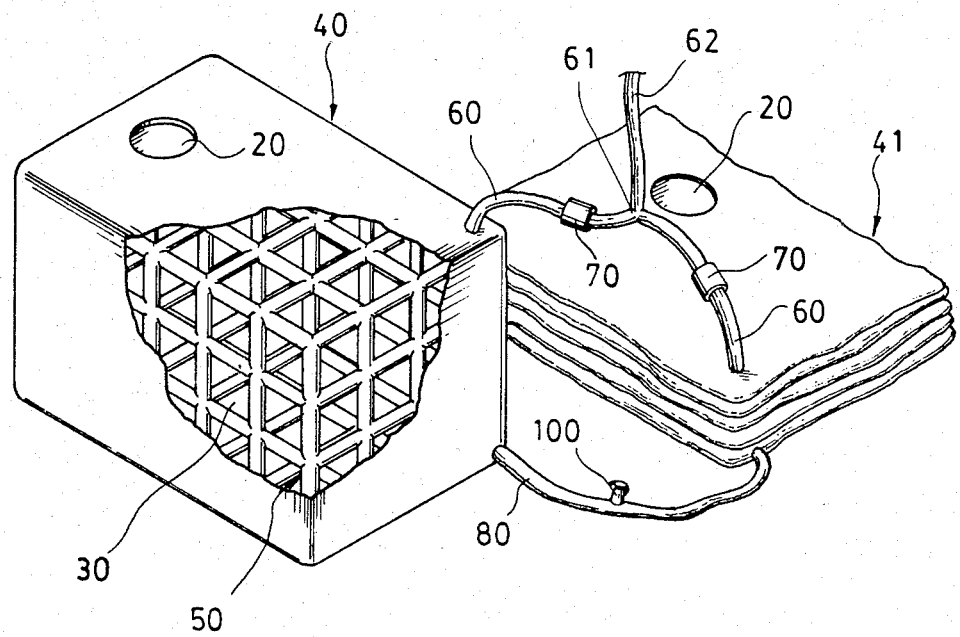
FIG. 3 shows Embodiment II of the present invention.

FIG. 3 is Embodiment II of the present invention wherein the pipe network is functionally equivalent to the supporting chamber 2 in FIG. 1, and it is connected with corresponding supporting means in the non-inflated chamber shown at the right in FIG. 3 by means of a hose so as to let the water flow between them. The external space surrounding the pipe network is equivalent to the pumping chamber 1 in FIG. 1.

In FIG. 3, the two rectangular bodies (left and right) are two pump bodies having exactly the same structure; the left pump body 40 is in an inflated state, while the right pump body 41 is in a deflated state. In the sectional view of the left pump body 40, there are a number of pumping chambers 30 formed between the tubular network structure 50. The function of the chambers 30 is equivalent to that of pumping chamber 1 in FIG. 1. The soft hose (tubular) network 50 is a form of a supporting chamber and is equivalent to that of the supporting chamber 2 in FIG. 1. The network 50 is made of a flexible film, being foldable. The supporting chambers of the two pump bodies communicate with each other so as to let the fluid flow back and forth between the two supporting chambers through connecting hose 80. The function of the connecting hose 80 is similar to that of the connecting hose 8 in FIG. 1. The connecting hose 80 is furnished with an openable and closeable inlet 100 which is equivalent to inlet 10 in FIG. 1. Through inlet 100 a suitable quantity of fluid may be filled into network 50 so as to operate the pumps as will be understood from this disclosure. Each of the aforesaid pump bodies 40 and 41 is provided with a one-way air inlet 20 which is equivalent to that of one-way air inlet 5 in FIG. 1. Inlet 20 permits air to enter into the pumping chamber. The top of each of the pump bodies is provided with an exhausting branch hose 60. Each exhaust branch hose 60 has a one-way valve 70 therein. Exhaust branch hoses 60 converge at exhaust port 61 and form exhaust hose 62. The combination of exhaust branch hose 60 and exhaust hose 62 is equivalent to that of the exhausting hose 6 in FIG. 1, i.e., to carry the fluid exhausting out of the pumping chambers 30.

Further, before operation, the operator fills enough fluid into a network 50 through inlet 100 so that it can just inflate a network 50 in one (left or right one) of the pump bodies 40 or 41; then, the operator closes inlet 100 immediately prior to operation. During operation, one of the two pump bodies 40 or 41 (left or right one) will be compressed at a time. When the right side pump body 41 is being deflated, the fluid in the tubular network 50, the supporting chamber of pump body 40 (on the left side of FIG. 3), is inflated. Simultaneously, pumping chamber 30 of pump body 40 is expanding by sucking in air through the one-way air inlet 20, While the pump body 41 on the right side is being compressed, the space in the pumping chamber 30 of the pump body 41 (not shown) is reduced thereby exhausting the air through an exhaust hose branch 60, through a valve 70, and then out through exhausting hose 62. Thus, as pump body 41 is compressed, the fluid in the supporting chamber (the network 50) flows out through connecting hose 80 and starts filling network 50 of pump body 40. This procedure can be alternated after the initial support fluid has been introduced through inlet 100. Therefore, the repetitive and alternative compression of the left or right pump body will provide a continuous output of air or other pumping fluid through the exhaust hose 62.

According to the above descriptions, the pump of the present invention is driven with a fluid to fill the support chamber which supports the pump chamber. The pumping chamber fills with a separate fluid through valve 5 as the support chamber fills with fluid. Upon removing the fluid from the supporting chamber, the separate fluid from the pumping chamber is exhausted out exhausting hose 6. The quantity and the pressure of fluid being used in the supporting chamber to drive the present invention may be small, but the quantity and pressure of the fluid to be pumped may be unlimited and very high.

This basic supporting theory may be employed for in inflating a lift-guard raft or may be employed in other commercial applications. The present invention will save manpower and be of material benefit to mankind.

I claim:

1. A pump composed of a flexible film consisting of a pumping chamber having a one-way valved intake port and a one-way valved exhaust port, a surrounding supporting chamber composed of a pipe network, said network having a combination intake/exhaust inlet, upon said supporting chamber being filled through said inlet with a first fluid, said pumping chamber expands, being supported by said support chamber, to absorb a second fluid through said intake port, and upon collapsing said support chamber by forcibly removing the fluid therefrom said pumping chamber discharges the fluid therein through said exhaust port, after which said pump is ready for the next cycle.

2. A pump composed of a flexible film consisting essentially of a pumping chamber having a one-way valved intake port and a one-way valved exhaust port, a surrounding supporting chamber having a combination intake/exhaust inlet, said respective chambers spaced apart by a plurality of interconnecting spacing films having openings therein whereby upon said supporting chamber being filled through said inlet with a first fluid, said pumping chamber expands, being supported by said surrounding support chamber, to absorb a second fluid through said intake port, and upon collapsing said support chamber by forcibly removing the fluid therefrom said pumping chamber discharges the fluid therein through said exhaust port, after which said pump is ready for the next cycle.

3. A pump according to claim 2, wherein a secondary chamber is furnished and is in communication with said supporting chamber so as to contain the fluid from said supporting chamber.

4. A pump according to claim 2, wherein a connecting matter is furnished at a suitable position between said pumping chamber and said supporting chamber so as to maintain a space between two walls of said chambers.

5. A pumping apparatus comprising:

a first pump, composed of a flexible film, having: a pumping chamber for containing a fluid with a one-way valved intake port and a one-way valved exhaust port, a surrounding supporting chamber having a combination intake/exhaust inlet, said respective chambers spaced apart by a plurality of interconnecting spacing films having openings therein;

a second pump, composed of a flexible film, having: a pumping chamber for containing a fluid with a one-way valved intake port and a one-way valved exhaust port, a surrounding supporting chamber having a combination intake/exhaust inlet, said respective chambers spaced apart by a plurality of interconnecting spacing films having openings therein;

a hose extending between said first pump and said second pump and communicating with each supporting chamber of each respective pump, said hose having a closable aperture, therein; and an exhaust hose having a hose exhaust port therein, a pair of hose branches, said exhaust hose connected to a respective hose branch communicating between a pumping chamber of each said pump and said hose exhaust port, each said hose branch having a one-way valve therein for permitting only exhaustion of a fluid from a respective pump chamber through said hose exhaust port.

* * * * *